US009551972B2

(12) United States Patent
Nakamura et al.

(10) Patent No.: US 9,551,972 B2
(45) Date of Patent: Jan. 24, 2017

(54) IMAGE FORMING APPARATUS

(71) Applicant: CANON KABUSHIKI KAISHA, Tokyo (JP)

(72) Inventors: Jun Nakamura, Tokyo (JP); Rin Ishikawa, Ushiku (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/966,543

(22) Filed: Dec. 11, 2015

(65) Prior Publication Data

US 2016/0179041 A1 Jun. 23, 2016

(30) Foreign Application Priority Data

Dec. 19, 2014 (JP) ..... 2014-257420
Dec. 7, 2015 (JP) ..... 2015-238187

(51) Int. Cl.
*G03G 15/00* (2006.01)
*G03G 15/23* (2006.01)

(52) U.S. Cl.
CPC ..... *G03G 15/6573* (2013.01); *G03G 15/6552* (2013.01); *G03G 15/234* (2013.01); *G03G 15/6529* (2013.01); *G03G 2215/00675* (2013.01)

(58) Field of Classification Search
CPC ..... G03G 15/6573
USPC ..... 399/401
See application file for complete search history.

(56) References Cited

U.S. PATENT DOCUMENTS 4,963,946 A * 10/1990 Maruta ..... G03G 15/234 399/402
5,060,025 A * 10/1991 Kummel ..... G03G 15/234 271/242
5,971,394 A * 10/1999 Kida ..... B42C 1/12 270/58.01
7,489,897 B2 * 2/2009 Nakamura ..... B41J 13/106 271/176
7,711,281 B2 * 5/2010 Hamano ..... G03G 15/50 399/407
8,838,008 B2 * 9/2014 Nara ..... B65H 29/58 271/184
9,193,546 B2 11/2015 Nakamura
(Continued)

FOREIGN PATENT DOCUMENTS

JP 2013-257383 A 12/2013

*Primary Examiner* — Anthony Nguyen
(74) *Attorney, Agent, or Firm* — Fitzpatrick, Cella, Harper & Scinto

(57) ABSTRACT

An image forming apparatus includes a transfer portion transferring a toner image onto a sheet, a fixing portion fixing the toner image which has been transferred by the transfer portion onto the sheet by using heat, a discharge path guiding the sheet on which the toner image has been fixed by the fixing portion to a discharge port, a branch path branched from the discharge path, a rotator pair providing on the branch path and conveying the sheet, and a control portion configured to rotate the rotator pair while consecutively discharging the sheets to the discharge port through the discharge path without passing through the branch path.

22 Claims, 6 Drawing Sheets

(56) References Cited

U.S. PATENT DOCUMENTS

| | | | | |
|---|---|---|---|---|
| 2002/0131802 | A1* | 9/2002 | Shimizu | G03G 15/6573 399/405 |
| 2002/0159805 | A1* | 10/2002 | Sato | G03G 15/6552 399/405 |
| 2009/0148210 | A1* | 6/2009 | Takenaka | G03G 15/234 399/381 |
| 2012/0155943 | A1* | 6/2012 | Taki | G03G 15/234 399/401 |

* cited by examiner

IMAGE FORMING APPARATUS

BACKGROUND OF THE INVENTION

Field of the Invention

The present invention relates to an image forming apparatus forming an image on a sheet.

Description of the Related Art

Hitherto, there is known an electro-photographic image forming apparatus such as a copier, a facsimile, and a laser printer that forms images on a first surface, i.e., a front surface, of a sheet and also on a second surface, i.e., a back surface of the sheet. In forming the images on the both surfaces of the sheet, such image forming apparatus forms a toner image on a photosensitive drum and transfers the toner image onto the first surface of the sheet, supplied from a sheet feeding portion, at a transfer portion.

Then, after fixing the toner image transferred onto the sheet as a permanent image by a fixing portion provided downstream of the image forming portion, the image forming apparatus conveys the sheet to a reverse portion. Then, the image forming apparatus conveys the sheet whose front and back surfaces are reversed by the reverse portion to the image forming portion again to form the image on the second surface of the sheet.

Here, the sheet is being heated to a predetermined temperature during a fixing process of fixing the toner image onto the sheet in the image forming apparatus, and due to the heat, there is a case when moisture contained in the sheet evaporates as vapors.

Therefore, there is a case that dew condensation occurs on a conveyance rollers due to the vapors generated from the sheet heated by the fixing portion. Then, if the dew condensation occurs, the moisture adheres on the sheet passing through the conveyance rollers. Then, there is a possibility that the moisture causes a defective image, conveyance failure, stain of the sheet or the like.

Then, Japanese Patent Application Laid-open No. 2013-257383 proposes an image forming apparatus including a fan blowing air to prevent the dew condensation. However, the image forming apparatus disclosed in Japanese Patent Application Laid-open No. 2013-257383 requires a fan large enough to prevent the dew condensation.

SUMMARY OF THE INVENTION

According to one aspect of the present invention, an image forming apparatus includes a transfer portion transferring a toner image onto a sheet, a fixing portion fixing the toner image which has been transferred by the transfer portion onto the sheet by using heat, a discharge path guiding the sheet on which the toner image has been fixed by the fixing portion to a discharge port, a branch path branched from the discharge path, a rotator pair provided on the branch path and conveying the sheet, and a control portion configured to rotate the rotator pair while consecutively discharging the sheets to the discharge port through the discharge path without passing through the branch path.

Further features of the present invention will become apparent from the following description of exemplary embodiments with reference to the attached drawings.

DESCRIPTION OF THE EMBODIMENTS

First Embodiment

Figure 1:
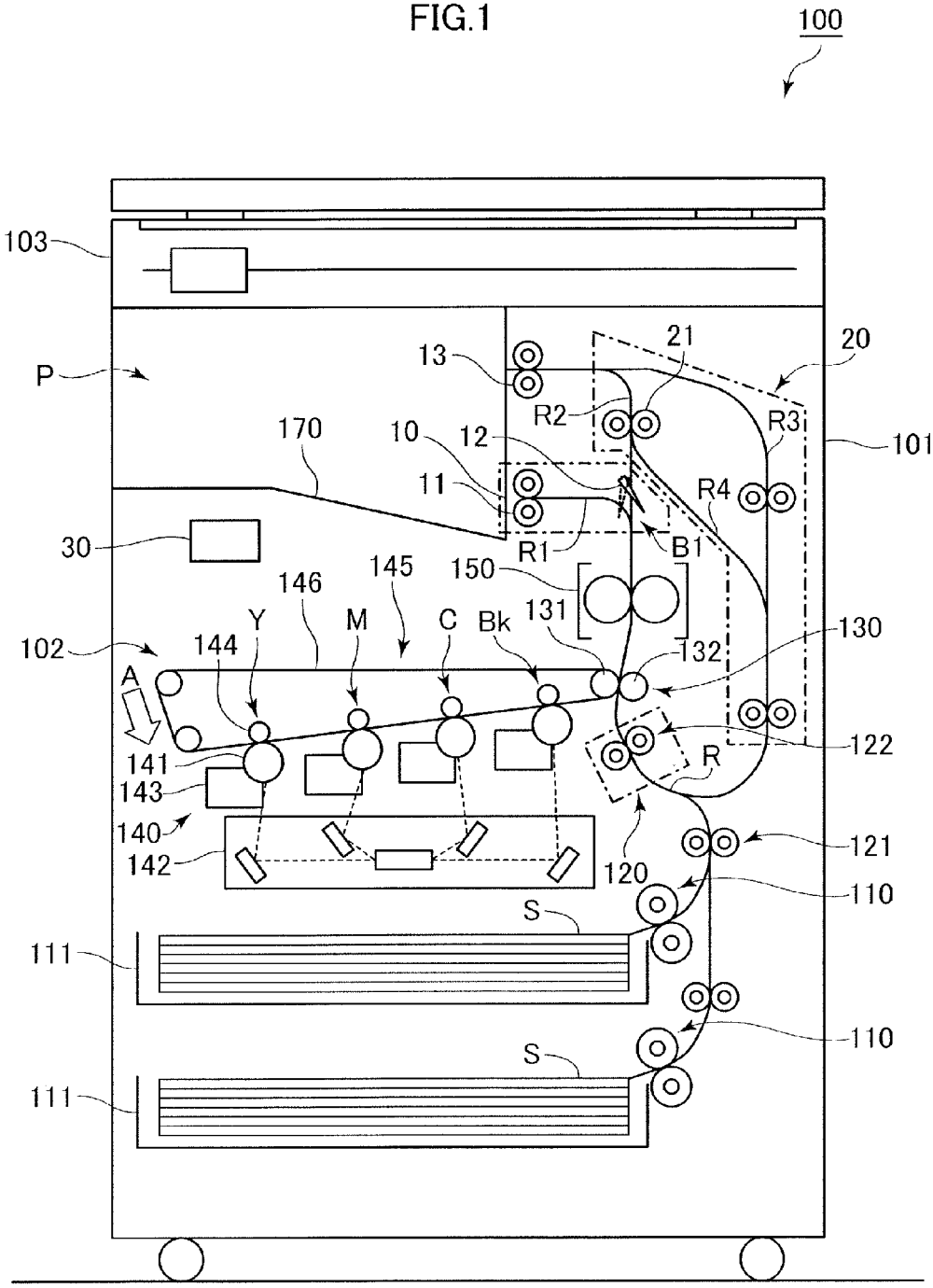
FIG. 1 is a schematic diagram illustrating a configuration of a laser beam printer, i.e., one exemplary image forming apparatus, of a first embodiment.

An image forming apparatus of a first embodiment will be described with reference to the drawings. FIG. 1 is a schematic diagram illustrating a configuration of a laser beam printer, i.e., one exemplary image forming apparatus, of the present embodiment. As shown in FIG. 1, the laser beam printer (referred to simply as a 'printer' hereinafter) 100 includes a printer body 101, i.e., a body of the image forming apparatus, an image forming portion 102 forming an image onto a sheet, and an image reading apparatus 103 installed substantially horizontally on the printer body 101. A discharge space P for discharging a sheet is formed between the image reading apparatus 103 and the printer body 101. The printer body 101 includes a sheet feeding portion 110 feeding the sheet S from a sheet feed cassette 111, a reverse conveying portion 20 conveying the sheet of which the image has been formed on a first surface thereof again to the image forming portion 102, and others.

The image forming portion 102 includes a scanner unit 142, and four process cartridges 140 forming toner images of four colors of yellow (Y), magenta (M), cyan (C), and black (Bk). Each process cartridge includes a photosensitive drum 141 and a developer 143. Still further, the image forming portion 102 includes an intermediate transfer unit 145 disposed above the process cartridge 140.

The intermediate transfer unit 145 includes an intermediate transfer belt 146 wrapped around a secondary transfer inner roller 131 and others. The intermediate transfer unit 145 also includes four primary transfer rollers 144 provided inside of a loop of the intermediate transfer belt 146 and being in contact with the intermediate transfer belt 146 at positions facing the respective photosensitive drums 141. Here, the intermediate transfer belt 146 is disposed so as to be in contact with the respective photosensitive drums 141 and rotates in a direction of an arrow A by being driven by a drive portion not shown. Then, the electrically negative respective color toner images on the respective photosensitive drums are sequentially transferred and superimposed onto the intermediate transfer belt 146 by electrically positive transfer bias applied by the primary transfer rollers 144 to the intermediate transfer belt 146. Thereby, a full-color toner image is formed on the intermediate transfer belt 146.

Disposed at a position facing the secondary transfer inner roller 131 of the intermediate transfer unit 145 is a secondary transfer roller 132. A nip formed by the secondary transfer inner roller 131 and the secondary transfer roller 132 composes a secondary transfer portion 130 transferring the full-color toner image formed on the intermediate transfer belt 146 onto a sheet S. Still further, a fixing portion 150 is disposed above the secondary transfer roller 132, and a first discharge roller pair 11 is disposed downstream in a sheet conveying direction of the fixing portion 150.

Still further, the printer body 101 includes a control portion 30 controlling an image forming operation, a sheet feeding operation, and a sheet conveying operation in forming images on both surfaces of the sheet of the printer 100. The printer body 101 also includes a first sheet conveying path R for conveying the sheet fed from the sheet feeding portion 110 to the image forming portion 102, and a second sheet conveying path R1 (discharge path) guiding the sheet on which the toner image has been formed by the image forming portion 102 and fixed by the fixing portion 150 to the a discharge port 10. Still further, the second sheet conveying path R1 is branched to a third sheet conveying path R2 (branch path). The third sheet conveying path R2 is provided with a reverse conveying roller pair 21 (rotator pair) conveying the sheet.

Next, the image forming operation of the printer 100 constructed as described above will be described. Along with start of the image forming operation, a laser beam is irradiated to the photosensitive drum 141 from the scanner unit 142 based on image information sent from a personal computer or the like not shown. Then, the surface of the photosensitive drum 141 electrified with predetermined polarity and potential is sequentially exposed, and an electrostatic latent image is formed on the photosensitive drum 141. After that, this electrostatic latent image is developed by toner and is visualized. Then, the toner images of four colors of yellow (Y), magenta (M), cyan (C), and black (Bk) formed on the respective photosensitive drums are transferred onto the intermediate transfer belt 146 by the transfer bias applied to the respective primary transfer rollers 144, and the full-color toner image is formed on the intermediate transfer belt 146. It is noted that toner left on the photosensitive drum is collected to a toner container (not shown) by a cleaning portion (not shown) provided in the process cartridge 140.

In parallel with the image forming operation described above, the sheet S stored in the sheet feed cassette 111 is delivered out by the sheet feeding portion 110. Then, the sheet S is conveyed by the conveying roller pair 121 to a skew correcting unit 120 to correct a skew thereof. Next, a conveying roller pair 122 provided in the skew correcting unit 120 rotate so as to synchronize a front edge of the sheet S whose skew has been corrected with a position of the full-color toner image on the intermediate transfer belt, and the sheet S is conveyed to the secondary transfer portion 130. Then, the full-color toner image is collectively transferred onto the sheet S at the secondary transfer portion 130 (transfer portion) by the secondary transfer bias applied to a secondary transfer roller 132.

Next, the sheet S onto which the full-color toner image has been transferred is conveyed to the fixing portion 150, and the toner image on the sheet S is fixed as a full-color image by melting and mixing the respective color toners by receiving heat and pressure at the fixing portion 150. After that, the sheet S on which the toner image has been fixed is discharged to a sheet discharge tray 170 provided at a bottom part of the discharge space P by the first discharge roller pair 11 provided along the second sheet conveying path R1.

It is noted that in a case when images are to be formed on both surface of a sheet, a switch member 12, i.e., a guide member, is moved from a first position, indicated by a solid line, guiding the sheet toward the first discharge roller pair 11 to a second position, indicated by a broken line, guiding the sheet toward the reverse conveying portion 20. The switch member 12 is provided in a branch part between the second sheet conveying path R1 and the third sheet conveying path R2 in a pivotable (movable) manner. Thereby, the sheet of which the image has been formed on the first surface thereof reaches a second discharge roller pair 13 provided along the third sheet conveying path R2 and capable of rotating in normal and reverse directions. After that, due to reverse rotation of the second discharge roller pair 13, the sheet is reversed and conveyed to the reverse conveying portion 20. After that, the sheet is conveyed again to the secondary transfer portion 130 via the reverse conveying portion 20, and an image is formed on the second surface opposite from the first surface.

Then, after fixing the toner image by the fixing portion 150 again, the sheet S of which the images have been formed on the both surfaces thereof is discharged on the discharge tray 170 by the first discharge roller pair 11. Or, in a case when a number of sheets stacked on the discharge tray 170 increases excessively, the switch member 12 may be moved to the first position to discharge the sheets on the discharge tray 170 from the second discharge roller pair 13.

The reverse conveying portion 20 also includes a first duplex conveying path R3 guiding the sheet switched back by the reverse conveying roller pair 21 to the first sheet conveying path R and a second duplex printing conveying path R4 guiding the sheet switched back by the second discharge roller pair 13 to the first sheet conveying path R. The reverse conveying roller pair 21 is disposed above a branch point B1 of the second sheet conveying path R1 and the third sheet conveying path R2. Then, in a case of conveying a small-size sheet again for example, the sheet is conveyed to the second duplex printing conveying path R4 by rotating the reverse conveying roller pair 21 in the reverse direction.

Figure 2:
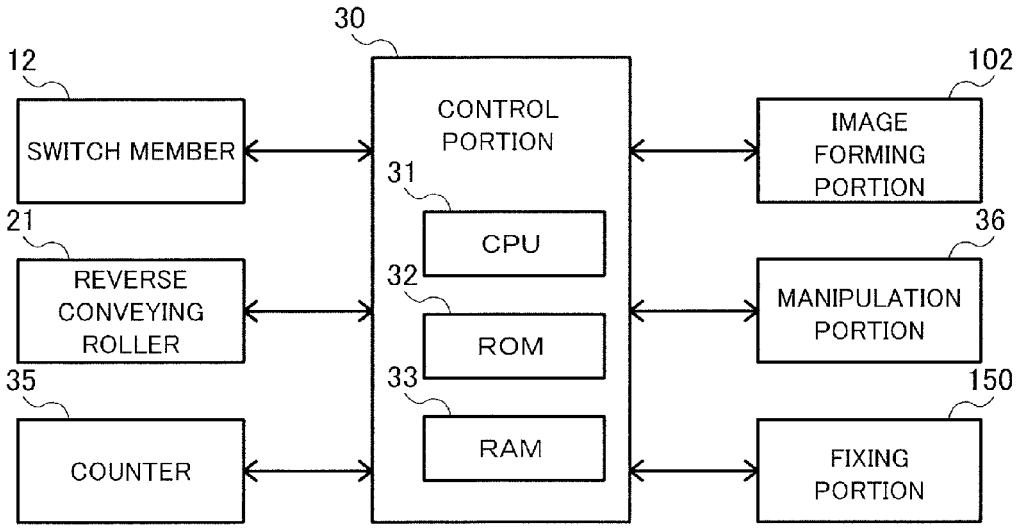
FIG. 2 is a control block diagram of the laser beam printer.

FIG. 2 is a control block diagram of the printer 100 of the present embodiment. As shown in FIG. 2, the control portion 30 includes a CPU 31, a ROM 32 storing control software and data, and a RAM 33 composing a work area of the CPU 31. Then, by developing the software and data read out of the ROM 32 on the RAM 33, the CPU 31 controls the respective portions of the printer 100 to implement a desired image forming process. In the present embodiment, the ROM 32 includes a simplex printing mode of printing an image on a single surface and a duplex printing mode of printing images on both surfaces of the sheet by conveying the sheet of which the image has been printed on one surface to the third sheet conveying path R2.

Still further, the control portion 30 is connected respectively with the image forming portion 102, the fixing portion 150, the switch member 12, the reverse conveying roller pair 21, and a counter 35 counting a number of sheets discharged out of the discharge port 10. The control portion 30 is also connected with a manipulation portion 36 setting a number of sheets consecutively discharged.

Then, the control portion 30 controls the image forming portion 102 to implement the image forming process such as the development and transfer and temperature of a heater and other of the fixing portion 150 implementing the image fixing process. The control portion 30 also controls the switch member 12 so as to switch to the first or second position by a solenoid not shown. Still further, in a case when a predetermined number or more sheets are to be consecutively discharged, the control portion 30 controls the reverse conveying roller pair 21 so as to rotate (idling) by a predetermined period of time before the consecutive discharge ends as described later.

By the way, in the case of discharging the sheet S on the sheet discharge tray 170 by the first sheet discharge roller pair 11, the sheet S will not pass through the reverse conveying roller pair 21, so that the reverse conveying roller pair 21 is at a standstill always in a pressure contact state.

Therefore, if the moisture of the sheets S evaporates in the fixing portion 150, vapors stay at a nip portion of the reverse conveying roller pair 21 located above the fixing portion 150 if the printer 100 is not fully warmed up for example.

Then, if the sheets S consecutively discharged amount a predetermined number of sheets, the vapors condensate at the nip portion of the reverse conveying roller pair 21. It is noted in the case of the simplex printing mode of forming an image only on the first surface (front surface), the larger the number of sheets discharged out of the first sheet discharge roller pair 11 or the larger the size of the sheets, the larger an amount of dew condensation at the nip portion of the reverse conveying roller pair 21 is.

If a sheet S is guided by the switch member 12 and is conveyed to the reverse conveying roller pair 21 in this state, the dew adhering to the nip portion of the reverse conveying roller pair 21 adheres to the sheet S. That is, if the sheet is conveyed to the reverse conveying roller pair 21 after consecutive discharge of the predetermined number or more sheets out of the first sheet discharge roller pair 11, the dew adheres to the sheet S. Then, when the sheet S passes through the secondary transfer portion 130 in this state after having been conveyed to the reverse conveying portion 20 to form images on the both surface thereof, no toner image is transferred to part to which the moisture has adhered of the sheet S. As a result, an abnormal image having traces of the dew condensation is formed on the sheet.

Then, according to the present embodiment, the arrangement is made in the case of the simplex printing mode so as to idly rotate the reverse conveying roller pair 21 before a sheet is conveyed by the reverse conveying roller pair 21. That is, the reverse conveying roller pair 21 rotates while nipping no sheet. This arrangement makes it possible to let the vapors staying in a vicinity of the reverse conveying roller pair 21 escape and to dry dews even if dew condensation occurs. It is noted that the rotation of the reverse conveying roller pair 21 must be limited as much as possible from aspects of energy saving and silence demanded lately.

Therefore, according to the present embodiment, in the case of the simplex printing mode and of consecutively discharging the predetermined number or more sheets, possibly causing dew condensation, the reverse conveying roller pair 21 is idly rotated for a predetermined period of time before the consecutive discharge of the sheets ends. Still further, a dew condensation preventing effect is enhanced by molding one or both of the reverse conveying roller pair 21 by a water-absorbing foam material that absorbs vapors and dews.

Figure 3:
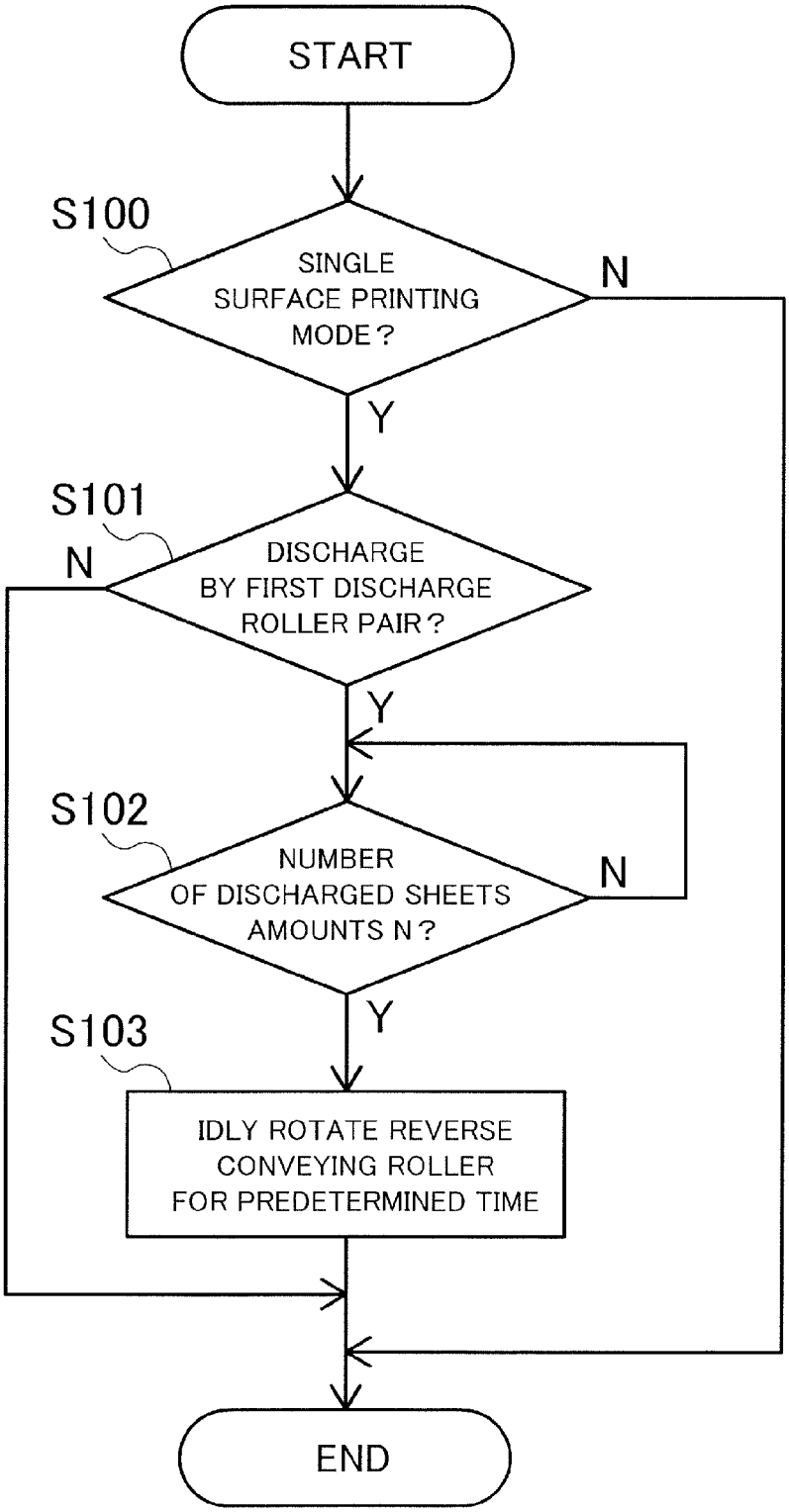
FIG. 3 is a flowchart illustrating drive control of a reverse conveying roller pair provided in the laser beam printer.

Next, drive control of the reverse conveying roller pair 21 of the present embodiment constructed as described above will be described with reference to a flowchart in FIG. 3. It is noted that in FIGS. 3 and 4, 'Y' means Yes, and 'N' means No. The control portion 30 confirms at first whether a printing mode of forming an image on a sheet is the simplex printing mode for forming the image on only a single surface of the sheet in Step S100. In the case of the simplex printing mode, i.e., Y in Step S100, the control portion 30 judges whether the sheet is discharged by the first sheet discharge roller pair 11 in Step S101. Here, dew condensation is liable to occur in the reverse conveying roller pair 21 in the case of discharging the sheets by the first sheet discharge roller pair 11 in the simplex printing mode. It is noted that in the present embodiment, a mode of discharging the predetermined number or more sheets out of the discharge port 10 in the simplex printing mode and through the second sheet conveying path R1 will be referred to as an 'idling mode'.

Therefore, after that, the control portion 30 determines whether or not a consecutive discharge of the predetermined number or more sheets has been set by the manipulation portion 36. In the case when the consecutive discharge of the predetermined number or more sheets are set and the sheets are to be discharged by the first sheet discharge roller pair 11, i.e., Y in Step S101, the control portion 30 determines whether the number of discharged sheets amounts to N, i.e., the predetermined number, by count information from the counter 35 in Step S102. Then, when the number of discharged sheets amounts to the predetermined number N, i.e., Y in Step S102, that is, the discharged sheet reaches the predetermined number N, the control portion 30 drives the reverse conveying roller pair 21 to idly rotate for a predetermined period of time in Step S103. It is noted that in the present embodiment, 'idling' refers to rotating the roller pair while nipping no sheet as described above. Still further, in a case when the number of sheets discharged to the discharge port 10 is less than the predetermined number of sheets N, the control portion 30 will not idly rotate the reverse conveying roller pair 21, i.e., N in Step S102.

It is noted that idling of the reverse conveying roller pair 21 here is executed even if another job of conveying sheets by using the reverse conveying roller pair 21 is not inputted in succession to the job described above of consecutively discharging the sheets by the first sheet discharge roller pair 11. It is so arranged to be able to quickly respond to another job even if the other job of conveying sheets by using the reverse conveying roller pair 21 is inputted. That is, the idling control of the reverse conveying roller pair 21 is executed before a sheet is conveyed through the third sheet conveying path R2.

It is possible to dry the dews even if the number of discharged sheets becomes the predetermined number of sheets N and the dew condensation has occurred while executing the idling mode by controlling the reverse conveying roller pair 21 as described above. Still further, it is possible to drive the reverse conveying roller pair 21 for a minimum required time and to improve energy saving and silence when a number of discharged sheets is small by rotating the reverse conveying roller pair 21 only when the number of consecutively discharged sheets is large in the simplex printing mode in which the dew condensation is liable to occur.

Furthermore, a downstream rotator pair disposed downstream in the sheet conveying direction of the reverse conveying roller pair 21 does not rotate while the reverse conveying roller pair 21 idly rotates. For example, the downstream rotator pair is the second discharge roller pair 13 or a rotator pair provided along the first duplex conveying path R3 in the present embodiment. Thereby, this arrangement makes it possible to improve energy saving and silence.

It is noted that the predetermined number of discharged sheets N differs depending on size of the sheet. Therefore, the predetermined number of discharged sheets N is set to be 10 sheets in a case when the sheet size is large and to be 20 sheets in a case when the sheet is small in the present embodiment. Still further, in a case when a number of sheets onto which images are formed in the simplex printing mode is large, there is a case when a number of sheets exceeding the predetermined number N is discharged again after implementing the drive control of the reverse conveying roller pair 21 as described above. In such a case, the reverse conveying roller pair 21 may be idly rotated again when a number of discharged sheets becomes the predetermined number N.

As described above, according to the present embodiment, in the case when the predetermined number or more sheets are consecutively discharged, the reverse conveying roller pair 21 is idly rotated for the predetermined period of time before the consecutive discharge of the sheets ends, i.e., when the number of discharged sheets becomes the predetermined number N. This arrangement makes it possible to dry the dews even if the dew condensation has occurred in the reverse conveying roller pair 21. As a result, it is possible to then prevent the dews from adhering to the sheet when a sheet is conveyed by the reverse conveying roller pair 21 and to prevent the ill-effects from exerting on the image quality by the dews.

Still further, it is possible to eliminate the dews without releasing the nip of the reverse conveying roller pair 21 by drying the dews by idly rotating the reverse conveying roller pair 21 for the predetermined period of time. Therefore, no mechanism releasing the nip of the reverse conveying roller pair 21 is required, so that the structure of the image forming apparatus is simplified. That is, in the case when the predetermined number or more sheets are consecutively discharged like the present embodiment, it is possible to prevent the dew condensation without complexifying and enlarging the image forming apparatus, by idly rotating the reverse conveying roller pair 21 for the predetermined period of time before the consecutive discharge of the sheets ends. Still further, it becomes unnecessary to always rotate the reverse conveying roller pair 21. Accordingly, it is possible to attain the configuration which is energy saving and is less influential in terms of operation sound.

It is noted that while the reverse conveying roller pair 21 is idly rotated when the number of discharged sheets becomes the predetermined number N in the present embodiment, the present invention is not limited to such arrangement. For instance, depending on an environment in which the printer 100 is installed, there is a case when the dew condensation has already occurred in starting to form an image in the simplex printing mode.

Figure 4:
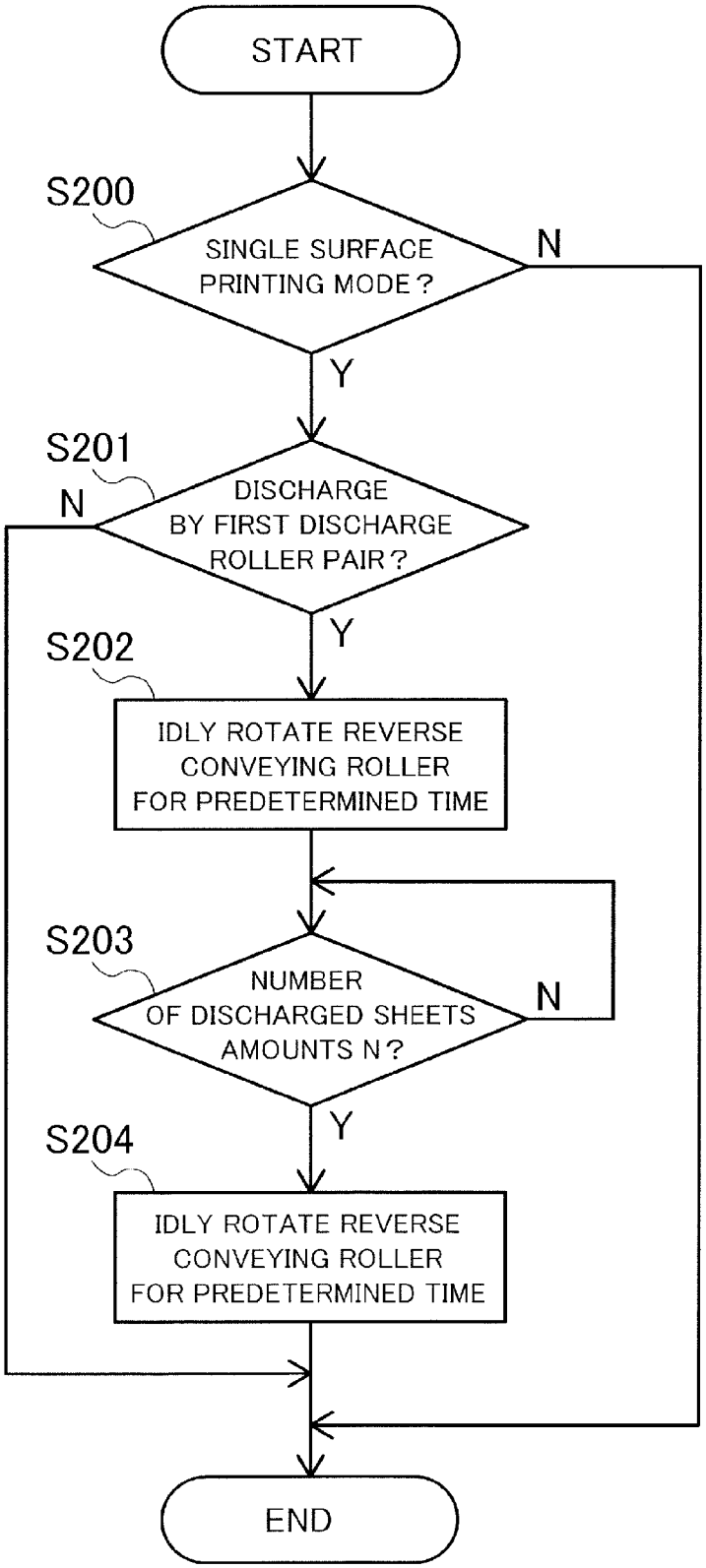
FIG. 4 is a flowchart illustrating another drive control of the reverse conveying roller pair.

In this case, as shown in a flowchart shown in FIG. 4, the control portion 30 determines whether or not a printing mode is the simplex printing mode in Step S200. Then, in a case when the printing mode is the simplex printing mode, i.e., Y in Step S200, and when the sheets are discharged by the first sheet discharge roller pair 11, i.e., Yin Step S201, the reverse conveying roller pair 21 is driven and is idly rotated for the predetermined period of time in Step S202 before a first sheet is conveyed. Then, the control portion 30 determines whether or not the number of discharged sheets has become the predetermined number N by count information from the counter 35 in Step S203. Then, when the number of discharged sheets has become the predetermined number N, i.e., Y in Step S203, the control portion 30 drives the reverse conveying roller pair 21 and idly rotates for the predetermined period of time in Step S204.

It is noted that if it is unable to fully prevent the dew condensation when the reverse conveying roller pair 21 is idly rotated when the number of discharged sheets exceeds the predetermined number N, it is also possible to drive the reverse conveying roller pair 21 for the predetermined period of time at early timing, i.e., when the number of discharged sheets is less than the predetermined number N. In other words, it is possible to control so as to start the rotation of the reverse conveying roller pair 21 during when the sheets are consecutively discharged from the second sheet conveying path R1. That is, if the control portion 30 is executing the idling mode, the reverse conveying roller pair 21 may be idly rotated at any timing.

Still further, if it is unable to fully prevent the dew condensation even if the reverse conveying roller pair 21 is rotated, a rotational speed of the reverse conveying roller pair 21 may be increased more than that in conveying a sheet. Still further, in a case when the sheets are discharged by the second sheet discharge roller pair 13 before the consecutive discharge of the sheets ends, it is also possible to drive the reverse conveying roller pair 21 to rotate idly for the predetermined period of time before the consecutive discharge of the sheets ends.

Second Embodiment

Figure 5:
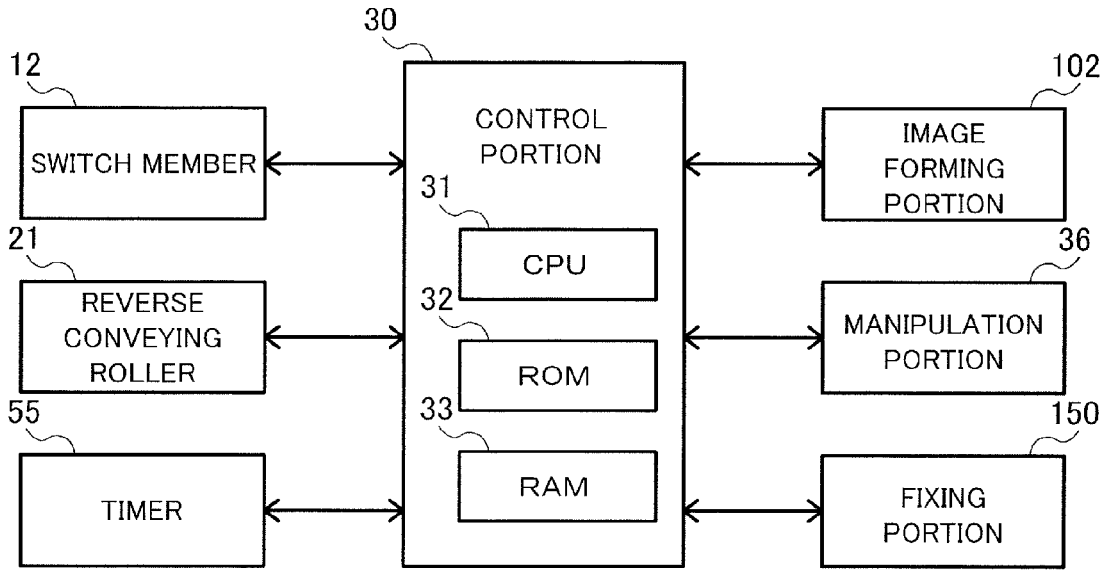
FIG. 5 is a control block diagram of a laser beam printer of a second embodiment.

In the first embodiment described above, the mode of idly rotating the reverse conveying roller pair 21 in response to the number of sheets, discharged out of the discharge port 10, that has become the predetermined number N in the simplex printing mode has been exemplified. According to a second embodiment, a timer 55 is connected, instead of the counter 35, with the control portion 30 as shown in FIG. 5.

Figure 6:
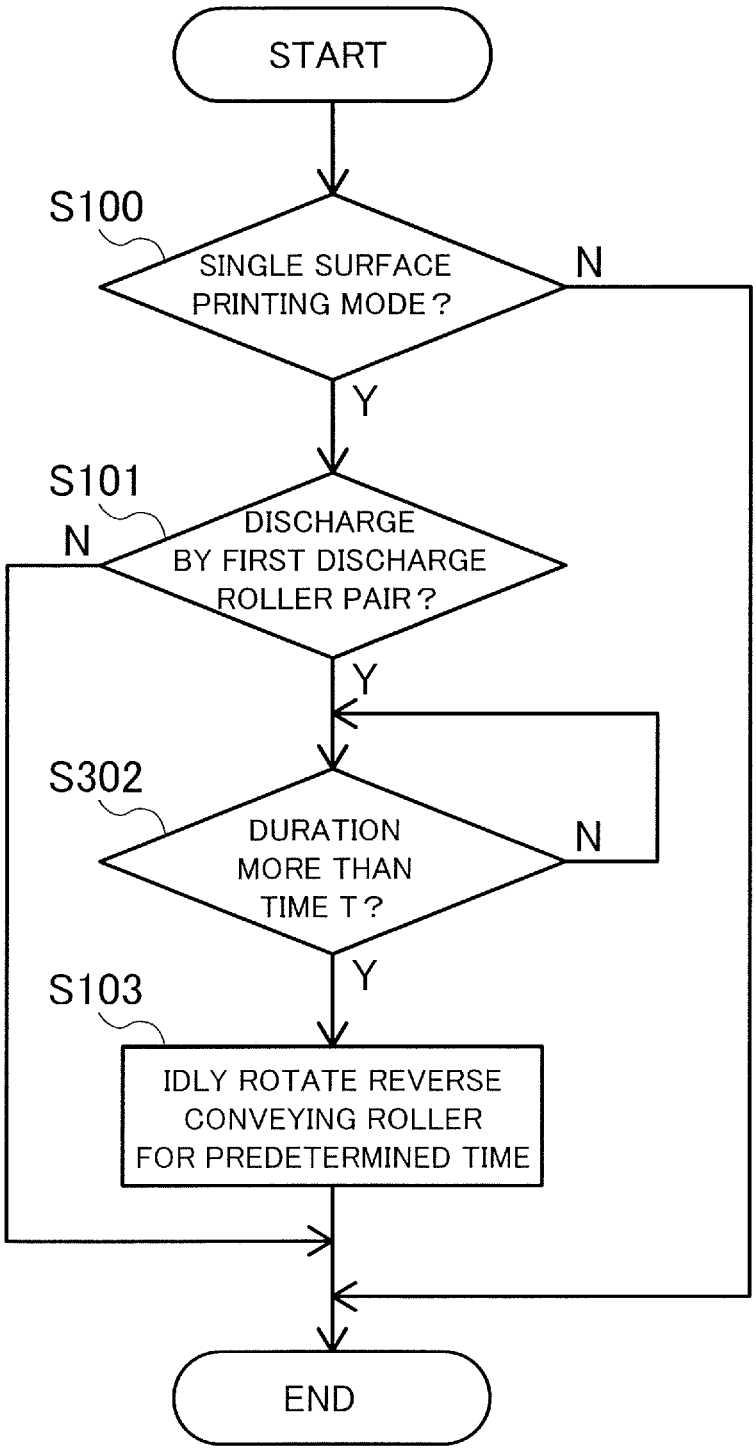
FIG. 6 is a flowchart illustrating drive control of a reverse conveying roller pair of the second embodiment.

A control flow of the control portion 30 in the second embodiment will be described below with reference to FIG. 6. In FIG. 6, same or corresponding components in FIGS. 2 and 3 described in the first embodiment will be denoted by same reference numerals and an explanation thereof will be omitted here. Here, an operation of consecutively discharging sheets from the discharge port 10 in the simplex printing mode will be referred to as a 'consecutive discharge operation'.

In a case of executing the consecutive discharge operation, i.e., Yin Step S101, the timer 55 measures a duration of the consecutive discharge operation. When the control portion 30 determines that the duration measured by the timer 55 exceeds a predetermined period of time T, i.e., Y in Step S302, the control portion 30 idly rotates the reverse conveying roller pair 21 for the predetermined period of time. Still further, when a time measured by the timer 55 is less than the predetermined period of time T i.e., N in Step S302, the control portion 30 does not idly rotate the reverse conveying roller pair 21.

It is noted that idling of the reverse conveying roller pair 21 here is executed even if another job of conveying a sheet by using the reverse conveying roller pair 21 is not inputted in succession to the job described above of consecutively discharging the sheets by the first sheet discharge roller pair 11. It is so arranged to be able to quickly respond to the other job when the other job of conveying the sheet by using the reverse conveying roller pair 21 is inputted. That is, the idling control of the reverse conveying roller pair 21 is executed before the sheet is conveyed through the third sheet conveying path R2.

This arrangement makes it possible to let the vapors staying in the vicinity of the reverse conveying roller pair 21 escape, to reduce the occurrence of the dew condensation, and to dry the generated dew condensation. Still further, this arrangement makes it possible to drive the reverse conveying roller pair 21 for a minimum required time and to improve energy saving and silence of the image forming apparatus.

It is noted that in the first and second embodiments, the reverse conveying roller pair 21 is not limited to be rollers, and one side or the both sides thereof may be composed of other rotator such as a belt.

OTHER EMBODIMENTS

Embodiments of the present invention can also be realized by a computer of a system or apparatus that reads out and executes computer executable instructions recorded on a storage medium, e.g., non-transitory computer-readable storage medium to perform the functions of one or more of the above-described embodiment(s) of the present invention, and by a method performed by the computer of the system or apparatus by, for example, reading out and executing the computer executable instructions from the storage medium to perform the functions of one or more of the above-described embodiment(s). The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-257420, filed Dec. 19, 2014, and Japanese Patent Application No. 2015-238187, filed Dec. 7, 2015, which are hereby incorporated by reference herein in their entirety.

What is claimed is:

1. An image forming apparatus comprising:

a transfer portion transferring a toner image onto a sheet;

a fixing portion fixing, by using heat, the toner image which has been transferred by the transfer portion onto the sheet;

a discharge path guiding, to a discharge port, the sheet on which the toner image has been fixed by the fixing portion;

a branch path branched from the discharge path;

a rotator pair provided on the branch path and conveying the sheet; and a control portion configured to start to rotate the rotator pair at a predetermined timing after starting an operation of consecutively discharging the sheets to the discharge port through the discharge path without passing through the branch path.

2. The image forming apparatus according to claim 1, wherein the control portion is configured to rotate the rotator pair in response to a predetermined number of sheets being consecutively guided to the discharge port through the discharge path.

3. The image forming apparatus according to claim 2, further comprising a counter counting a number of sheets consecutively discharged out of the discharge port, wherein the control portion is configured to rotate the rotator pair in response to the number of sheets counted by the counter being the predetermined number of sheets.

4. The image forming apparatus according to claim 2, wherein the control portion does not rotate the rotator pair in a case when the number of sheets consecutively discharged out of the discharge port through the discharge path is less than the predetermined number of sheets.

5. The image forming apparatus according to claim 2, wherein the predetermined number of sheets is set corresponding to size of the sheet.

6. The image forming apparatus according to claim 1, wherein the control portion is configured to rotate the rotator pair in response to a duration of an operation of discharging sheets to the discharge port through the discharge path being a predetermined time.

7. The image forming apparatus according to claim 6, further comprising a timer measuring the duration of the operation, wherein the control portion is configured to rotate the rotator pair in response to the duration measured by the timer being the predetermined time.

8. The image forming apparatus according to claim 6, wherein the control portion does not rotate the rotator pair in a case when the duration of the operation is less than the predetermined time.

9. The image forming apparatus according to claim 6, wherein the predetermined time is set corresponding to size of the sheet.

10. The image forming apparatus according to claim 1, wherein the branch path guides the sheet, on which the toner image has been formed, again to the transfer portion.

11. The image forming apparatus according to claim 1, wherein the rotator pair is disposed above the fixing portion.

12. The image forming apparatus according to claim 1, further comprising a downstream rotator pair (a) provided on the branch path and (b) being disposed downstream, in a sheet conveying direction, of the rotator pair, wherein the control portion does not rotate the downstream rotator pair while consecutively discharging the sheets to the discharge port through the discharge path without passing through the branch path.

13. The image forming apparatus according to claim 1, wherein the control portion increases a rotational speed of the rotator pair while consecutively discharging the sheets to the discharge port through the discharge path without passing through the branch path such that the rotational speed becomes faster than that in guiding a sheet to the branch path.

14. The image forming apparatus according to claim 1, wherein at least one of the rotator pair is formed of a foam member.

15. The image forming apparatus according to claim 1, further comprising a guide portion provided at a branch part between the discharge path and the branch path and being movable between a first position of guiding a sheet toward the discharge port and a second position of guiding a sheet to the branch path.

16. The image forming apparatus according to claim 1, wherein the control portion is capable of stopping the rotator pair which is rotating while consecutively discharging the sheets to the discharge port through the discharge path without passing through the branch path.

17. An image forming apparatus, comprising:

a transfer portion transferring a toner image onto a sheet;

a fixing portion fixing, by using heat, the toner image which has been transferred by the transfer portion onto the sheet;

a discharge path guiding, to a discharge port, the sheet on which the toner image has been fixed by the fixing portion;

a branch path branched from the discharge path;

a rotator pair provided on the branch path and conveying the sheet; and a control portion configured to start to rotate the rotator pair in response to consecutively discharging a predetermined number of the sheets to the discharge port through the discharge path without passing through the branch path.

18. The image forming apparatus according to claim 16, wherein the rotator pair is disposed above the fixing portion.

19. The image forming apparatus according to claim 16, wherein the control portion is capable of stopping the rotator pair which is rotating while an operation of consecutively discharging the sheets to the discharge port through the discharge path without passing through the branch path is performed.

20. An image forming apparatus, comprising:

a transfer portion transferring a toner image onto a sheet;

a fixing portion fixing, by using heat, the toner image which has been transferred by the transfer portion onto the sheet;

a discharge path guiding, to a discharge port, the sheet on which the toner image has been fixed by the fixing portion;

a branch path branched from the discharge path;

a rotator pair provided on the branch path and conveying the sheet; and a control portion configured to start to rotate the rotator pair in response to consecutively discharging the sheets for a predetermined time to the discharge port through the discharge path without passing through the branch path.

21. The image forming apparatus according to claim 20, wherein the rotator pair is disposed above the fixing portion.

22. The image forming apparatus according to claim 20, wherein the control portion is capable of stopping the rotator pair which is rotating while an operation of consecutively discharging the sheets to the discharge port through the discharge path without passing through the branch path is performed.

* * * * *